United States Patent [19]

Gagon et al.

[11] Patent Number: 4,545,278

[45] Date of Patent: Oct. 8, 1985

[54] APPARATUS AND METHOD FOR ADJUSTING THE CHARACTERISTIC SOUNDS OF ELECTRIC GUITARS, AND FOR CONTROLLING TONES

[75] Inventors: Paul R. Gagon, Whittier; Roger F. Cox, Chino, both of Calif.

[73] Assignee: Fender Musical Instruments Corporation, Fullerton, Calif.

[21] Appl. No.: 482,589

[22] Filed: Apr. 6, 1983

[51] Int. Cl.[4] ..... G10H 3/00

[52] U.S. Cl. ..... 84/1.15; 84/1.16

[58] Field of Search ..... 48/1.15, 1.14, 1.16

[56] References Cited

U.S. PATENT DOCUMENTS

| | | | |
|---|---|---|---|
| 1,896,683 | 2/1933 | Clark . | |
| 2,784,631 | 3/1957 | Fender | 84/1.15 |
| 2,817,261 | 12/1957 | Fender | 84/1.16 |
| 2,817,708 | 12/1957 | Fender | 179/1 |
| 2,976,755 | 3/1961 | Fender | 84/1.16 |
| 3,147,447 | 9/1964 | Fender | 330/180 |
| 3,177,283 | 4/1965 | Fender | 84/1.16 |
| 3,340,343 | 9/1967 | Woll | 84/1.13 |
| 3,472,943 | 10/1969 | Kawabata et al. | 84/1.15 |
| 3,493,669 | 2/1970 | Elbrecht et al. | 84/1.16 |
| 3,514,723 | 5/1970 | Cutler | 333/28 |
| 3,518,353 | 6/1970 | Appleton | 84/1.15 |
| 3,668,295 | 6/1972 | Broussard | 84/1.15 |
| 3,769,459 | 10/1973 | Niffenegger et al. | 381/102 |
| 3,915,048 | 10/1975 | Stich | 84/1.14 |
| 4,006,441 | 2/1977 | Goodrich | 338/153 |
| 4,092,893 | 6/1978 | Beach | 84/1.11 |
| 4,135,426 | 1/1979 | Rickard | 84/1.16 |
| 4,164,163 | 8/1979 | Rhodes | 84/1.15 |
| 4,188,849 | 2/1980 | Rickard | 84/1.15 |
| 4,227,048 | 10/1980 | Nagata | 381/101 |
| 4,245,540 | 1/1981 | Groupp | 84/1.14 |

*Primary Examiner*—Forester W. Isen

*Attorney, Agent, or Firm*—Gausewitz, Carr, Rothenberg & Edwards

[57] ABSTRACT

To adjust the characteristic sounds produced by electric guitars and other musical instruments, the present apparatus and method provide for varying the resistive loading on the electromagnetic pickups of such instruments. This changes the shape of the peak of the resonance curve caused by the self-resonance of the electromagnetic pickup. A predetermined fixed resistance is maintained in the circuit at all times, such that when a control element is at a certain known position, the output curve from the pickup will be substantially flat and, furthermore, the apparent volume generated by the instrument will not be reduced substantially. To change volume, a volume-control potentiometer is provided. In the preferred form, a single control element not only adjusts the characteristic sounds produced by electric guitars or other musical instruments having electromagnetic pickups, but also provides roll-off of higher frequencies at some desired region within the audio spectrum. In one embodiment, the peak of the resonance curve is shifted along the audio spectrum.

17 Claims, 7 Drawing Figures

APPARATUS AND METHOD FOR ADJUSTING THE CHARACTERISTIC SOUNDS OF ELECTRIC GUITARS, AND FOR CONTROLLING TONES

BACKGROUND OF THE INVENTION

Because the vast majority of electric guitars have solid bodies, the generated sounds are determined, not by the body, but by the pickups and associated controls and amplifiers. Electromagnetic pickup design, in particular, has been the subject of a great amount of effort. In strenuous attempts to achieve what may be called "magic sounds" and thus obtain increased market share, the numerous factors which go into the design of electromagnetic pickups have been varied in an infinite number of ways. These factors include number of turns, size of wire, type and construction (and materials) of magnets, spacing from strings, and so forth.

Electromagnetic pickups for guitars and other musical instruments are inherently resonant in nature. The inductance necessary for resonance is present in the windings, while the capacitance is distributed along the windings as well as being present along the leads to which the windings connect. Different electromagnetic pickups have different "characteristic sounds" determined primarily by their resonance curves. The relative steepness or flatness of the peaks of the curves is important, as is the location of the peaks on the frequency band.

It is conventional for electric guitars to incorporate tone controls which do nothing other than pass, in a controlled way, the higher or lower frequencies in the audio range. Such elements do not permit any true adjustment of the "characteristic sounds" of their associated pickups. In fact, such elements have in the past done relatively little to satisfy the desires of musicians.

SUMMARY OF THE INVENTION

The present method and apparatus effect, and in a highly simple and inexpensive manner, desired adjustments of the characteristic sounds generated by the electromagnetic pickups of guitars and other musical instruments. For example, if a certain pickup has a relatively steep and sharp resonance curve, the present system permits that curve to be adjusted to numerous less-steep and less-sharp resonance curves, so that the characteristic sound becomes progressively less "bright". Very importantly, the present invention permits the resonance peak to be eliminated, so that the output is flat and what is called a "jazz" sound is achieved. (With a "jazz" sound, there is not the overemphasis of the higher-frequency components such as is present with a typical guitar pickup.) It is of major importance that the adjustment of the resonance curve of an electromagnetic guitar pickup is changed all the way from steeply-peaked to flat without a substantial reduction in the apparent volume of the generated sound.

In accordance with another major aspect of the invention, the location of the resonance peak on the audio spectrum is adjusted, in a controlled manner, to change the characteristic sound in a different way.

In accordance with a further aspect of the present invention, a single control element is caused, when rotated through only one revolution, to change the generated sound from "bright" to the flat "jazz" sound, and then to progressively more "bassey" sounds. The latter sounds result when the higher frequencies have been rolled off (diminished markedly) within the audio band so that the listener hears primarily the lower-frequency components of the audio spectrum. In one embodiment, such single control element is selectively operable to shift the position of the resonance peak.

DETAILED DESCRIPTION

Figure 1:
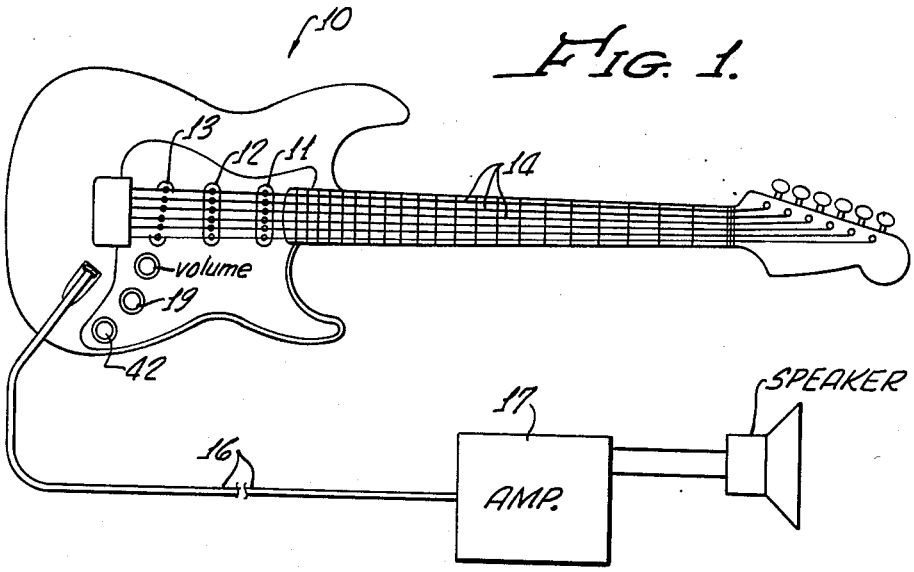
FIG. 1 is a plan view illustrating a typical electric guitar connected through a cord to an amplifier, such guitar having the present control on the body thereof.

Referring first to FIG. 1, there is shown a solid-body guitar 10 having a front electromagnetic pickup 11 (nearest the neck), a middle electromagnetic pickup 12, and a back electromagnetic pickup 13. (The number of pickups is not, however, of importance.) Each pickup 11–13 comprises a permanent magnet means and a large number of turns of wire inductively associated with the magnetizable strings 14 of the guitar 10. The output of the pickups, after being modified by the control means described below, is fed through a cord 16 to an amplifier 17 located at some distance from the guitar. The amplifier 17 incorporates various tone and volume controls, but it is emphasized that most musicians desire to effect tonal adjustments while playing the instrument, and thus require that control elements be on the body of the guitar itself.

Figure 2:
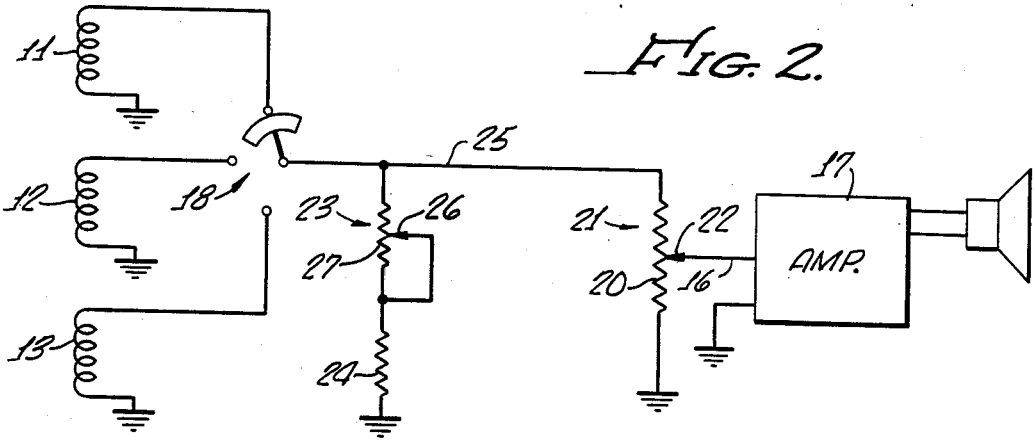
FIG. 2 is a circuit diagram schematically illustrating one embodiment of the present invention.

As shown in FIG. 2, the pickups 11–13 connect to different terminals of a selector switch 18 mounted on the guitar body, such switch being operated by a knob 19 (FIG. 1) or other suitable actuator. The output from the selector switch is connected to the resistor 20 of a volume-control potentiometer 21 the wiper 22 of which is connected through the above-mentioned cord 16 to the input of amplifier 17. The selector switch is adjustable to positions causing any single pickup to be in circuit, or causing a number of pickups to be in circuit in parallel relationship to each other.

Referring to FIG. 2, the illustrated embodiment comprises a rheostat 23 and fixed resistor 24 connected in series-circuit relationship between an output lead 25 (which extends from switch 18 to potentiometer 21) and ground (it being understood that each pickup 11–13, potentiometer resistor 20, and amplifier 17 is likewise grounded). Wiper 26 of the rheostat 23 is electrically connected to one end of the resistor element 27 thereof; thus, as the wiper 26 is moved, progressively greater or lesser portions of the resistor 27 are shorted out of the circuit.

Figure 5:
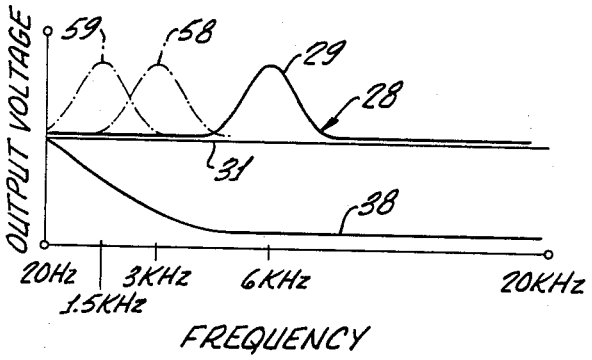
FIG. 5 is a graph generally representing output voltages as functions of frequency and of the setting of the control element.

Each pickup 11–13 is self-resonant because of the inductance of the winding, and the capacitance distributed along the winding as well as along the leads therefrom. Thus, each pickup has a characteristic curve which includes a resonance peak. Referring to FIG. 5, which is a schematic representation not to scale and not made from actual test data, the characteristic curve of a typical pickup 11, 12 or 13 is shown at 28. The resonance peak 29 of curve 28 has a shape, and a location on the audio spectrum, determined by the physical characteristics of the pickup. Except at the resonance peak 29, the characteristic curve represents a substantially constant output voltage throughout the audio spectrum from 20 Hz. to frequencies approaching 20 KHz.

In accordance with one aspect of the present method, the characteristic curve 28, and particularly the resonance peak 29 thereof, is altered—as desired by the musician—to any shape from the one illustrated to one at which the output voltage is substantially completely flat (level), yet with substantially undiminished apparent volume throughout the audio spectrum. Such a flat or level output voltage is indicated by the curve 31. To accomplish this result, and thus adjust the characteristic sound generated by the electric guitar 10 (that is to say, by the pickups thereof), wiper 26 is moved along resistor 27 to thereby vary the loading on the particular pickup (or pickups) to which the rheostat 23 is connected via selector switch 18.

Assuming that the wiper 26 is initially positioned adjacent the lower end of resistor 27 as viewed in FIG. 2, the full value of resistor 27 is in circuit between output lead 25 and ground, via the fixed resistor 24. The combined resistances of resistors 27 and 24 are such that relatively little current flows therethrough to ground, the result being that power from the pickup is transmitted along lead 25 to potentiometer 21 in substantially undiminished condition. Thus, the characteristic curve of the pickup is not disturbed, but instead has the shape indicated at 28–29 in FIG. 5 (it being understood that the shape indicated in FIG. 5 is merely exemplary, and that different types of pickups have different shapes and locations of resonance peaks).

Let it next be assumed that the wiper 26 is moved somewhat upwardly from the lower end of resistor 27. The resistance of such lower end is thus no longer in circuit. The result is that the resistive loading on the pickup is increased (by lowering the load resistance seen by this pickup), which causes the resonance peak to be less high and more wide than that illustrated at 29 in FIG. 5 (have a lower Q). Progressively further upward shifting of slider 26 causes progressive lowering and widening of the resonance peak until, when the slider is at the extreme upper end of resistor 27, the resonance peak is substantially or completely eliminated and the flat curve 31 (FIG. 5) is substituted therefor.

Thus, in the described simple and economical manner, readily effected by the guitarist while actually playing the instrument since the control is located on the body of the guitar, the characteristic sound generated by the pickup is changed from relatively bright to the smooth or mellow jazz sound represented by the level curve 31. (It is emphasized that, throughout this specification and claims, such words as "bright", "jazz", "bassey", etc., represent the subjective response of the musician and other listeners, and are not absolute in nature.)

The value of resistor 27 is caused to be sufficiently high to (a) maintain the full characteristic sound of the associated pickup when slider 26 is at the lower end of resistor 27, and (b) create a major change in sound as slider 26 moves. For example, the value of resistor 27 is one megohm.

The value of the fixed resistor 24 is critical, being selected to prevent a substantial decrease in the volume which the listener senses (this not necessarily being the same as the volume determined by a decibel meter), even when slider 26 is at the upper end of resistor 27. On the other hand, the value of resistor 24 is caused to be sufficiently low that, when the slider 26 is at the upper end of its resistor, the output curve 31 will be substantially flat as shown.

The exact value of resistor 24 varies with the resistance of each pickup 11–13, which in turn is determined by the number of turns and the wire size. For substantially all commercial electromagnetic pickups for electric guitars, the value of resistor 24 is caused to be in the range of 10 kilohms to 50 kilohms. Stated more exactly, the resistance value of element 24 is caused to be in the range of 20 kilohms to 30 kilohms. As a specific example, where each pickup 11–13 has between eight and ten thousand turns of forty-two gauge copper wire, the value of resistor 24 is caused to be about 33 kilohms. In the same specific example, and where the value of resistor 27 is one megohm, the value of the resistor 20 of potentiometer 21 is 500 kilohms, assuming that there is no amplifier means on the input side of the potentiometer.

EMBODIMENT OF FIGS. 3 AND 6

Figure 3:
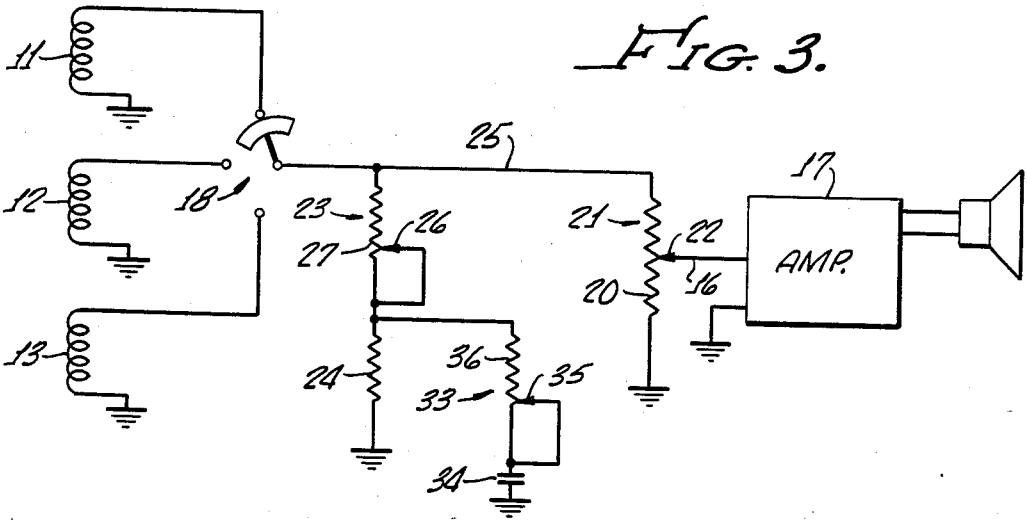
FIG. 3 is a diagram schematically illustrating a second, and preferred, embodiment of the invention.

FIG. 3 illustrates an embodiment, being the preferred embodiment, in which the output may be adjusted from the characteristic bright sound (curve 28 in FIG. 5) to the jazz sound represented by the flat curve 31 and, furthermore, a roll-off of the high frequencies is effected in the audio range so as to achieve a bassey sound when desired. (Corresponding reference numbers in FIGS. 2 and 3, and other figures, denote corresponding elements.)

The series combination of a rheostat 33 and capacitor 34 is connected in series-circuit relationship between ground and the junction of resistors 24–27. Furthermore, the relationships are caused to be such that rheostats 23 and 33 do not operate simultaneously, but instead sequentially. Thus, the wiper 35 of rheostat 33 does not start to move along the resistor 36 of such rheostat until wiper 26 of rheostat 23 has moved the entire length of its resistor 27 (this being when the sound is being changed from bright to jazz to bassey).

The value of capacitor 34 is so selected that, when the resistance value of rheostat 33 becomes sufficiently low, there will be a major roll-off of the higher frequencies at some desired point within the audio range. This produces, for example, the curve indicated at 38 in FIG. 5. Conversely, the resistance value of rheostat 33 is caused to be sufficiently high that, prior to shorting-out of any portion of resistor 36, the higher frequencies in the audio range will not diminish substantially.

As a specific example, the value of resistor 36 may be 250 kilohms, while the value of capacitor 34 may be 0.022 microfarads. In such specific example, the values of resistors 24 and 27 are the same as in the specific example given previously. (The impedances presented by resistor 36 and capacitor 34 are sufficiently high, in the great majority of the audio spectrum, that the value of resistor 24 may be the same in the specific examples of the embodiments of both FIG. 2 and FIG. 3.)

As indicated in FIG. 5, the various component values are preferably so selected that the output voltages will be substantially the same, for all settings of the control element, at the lower end of the audio range (for example, at 20 Hz).

Figure 6:
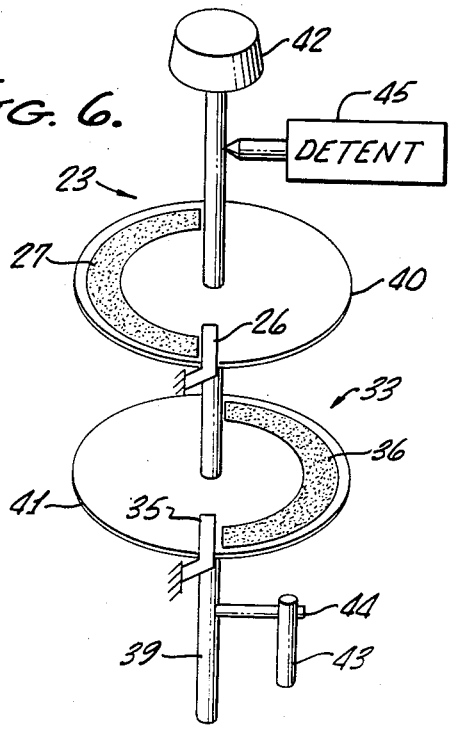
FIG. 6 is a view schematically illustrating a single control element adapted to effect the progressive change in sound, from bright to jazz to bassey, in a single revolution.

Referring next to FIG. 6, there is schematically indicated a preferred dual rheostat containing both rheostats 23 and 33. The dual rheostat comprises a shaft 39 on which are fixedly mounted upper and lower insulating discs 40 and 41. Resistive films are sprayed onto the surfaces of discs 40 and 41 to form resistors 27 and 36, respectively. Each film resistor extends for approximately 180 degrees, and each is offset approximately 180 degrees from the other.

Shaft 39 is suitably journaled in the body of guitar 10 (FIG. 1), and is rotated by a knob 42. A stop 43 (FIG. 6) is associated with an arm 44 on shaft 39 in such manner that the shaft may be turned through only one revolution. The position of stop 43 is correlated to the positions of the films and of fixed wipers 26 and 35 of rheostats 23 and 33. The relationships are such that the elements are located as illustrated in FIG. 6 when shaft 39 is in its fully-clockwise position as viewed from above. (It is to be understood that the construction schematically represented in FIG. 6 is given by way of example only, not limitation. For example, movement of the dual rheostat may be linear instead of rotational.)

In performing the method relating to the embodiment of FIG. 3, and employing the exemplary control apparatus shown in FIG. 6, let it be assumed that shaft 39 is initially in its fully-clockwise position as viewed from above, arm 44 being blocked by stop 43 as shown. This position corresponds generally to the positions of sliders 26 and 35 shown in FIG. 3. (In the stated example, counterclockwise rotation of shaft 39, as viewed from above, corresponds to upward movement of sliders 26 and 35 in FIG. 3.) When the control is in the stated position, none of the resistance of resistors 27 and 36 is shorted out. Thus, substantially the full output voltage of one or more of pickups 11–13 is transmitted along output lead 25 is potentiometer 21, to produce the subjective bright sound represented by curve 28–29 shown in FIG. 5.

To change the characteristic curve of the pickup by a desired amount, the musician turns knob 42 counterclockwise, causing resistor 27 to shift progressively beneath wiper 26. At the same time resistor 36 moves away from its wiper 35, there thus being no shorting out of any portion of resistor 36. The decrease in the effective resistance of resistor 27 changes the characteristic curve 28 (FIG. 5) to anything between the illustrated one and one having a relatively wide "peak" much lower than is shown at 29.

After resistor 27 has moved all the way past wiper 26 during counterclockwise rotation of shaft 39, only the resistance of resistor 24 remains effectively in circuit (the combined impedance of resistor 36 and capacitor 34 being relatively high as above indicated). Since the resistance of resistor 24 is selected to create the flat curve numbered 31 in FIG. 5, there is no emphasis or overemphasis of the highs, and the sound has been converted from bright to jazz.

Preferably, a detent 45 is associated with shaft 39 and provides resistance to shaft rotation immediately after resistor 27 has moved counterclockwise beneath wiper 26, and immediately prior to commencement of movement of resistor 36 beneath its wiper 35. The musician can thus feel when the control is in the position creating the flat response indicated by curve 31. When the musician desires a bassey sound, he overcomes the resistance presented by detent 45 and effects additional counterclockwise rotation of shaft 39, so that resistor 36 commences to move beneath its wiper 35. Greater and greater portions of resistor 36 are thus shorted out, and more and more of the higherfrequency components are grounded through capacitor 34 to result in the curve 38. (The curve 38 corresponds to the fully-counterclockwise position of shaft 39. Curve 28–29 corresponds to the fully-clockwise position thereof.)

EMBODIMENT OF FIG. 4

Figure 4:
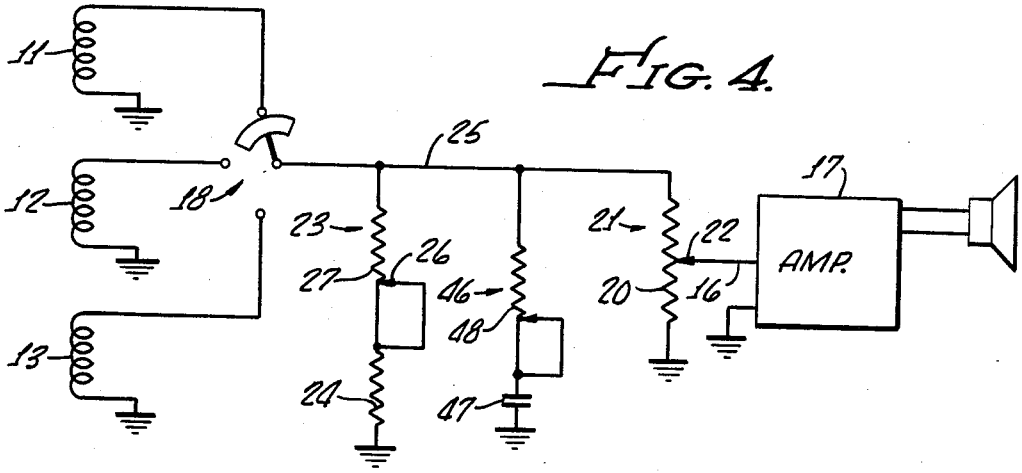
FIG. 4 is a diagram of an additional embodiment.

In the embodiment of FIG. 4, the series combination of a rheostat 46 and capacitor 47 is connected between ground and output lead 25, there being no connection to the junction between resistors 24 and 27. Such a construction, however, is not preferred (in that it produces undesired relationships between component values at certain settings of the knob 42 and shaft 39 shown in FIG. 6). Rheostat 46 is incorporated in the control of FIG. 6, in place of rheostat 33.

The value of resistor portion 48 of rheostat 46 is caused to be much higher than that of resistor 36, to prevent diminution of the apparent brightness discerned by the listener when shaft 39 is in its fully-clockwise position.

As a specific example, the value of resistor 48 may be 5 megohms. That of capacitor 47 may be 0.05 microfarads.

The musician operates the apparatus of FIGS. 4 and 6 in the same manner that he operates that of FIGS. 3 and 6.

EMBODIMENT OF FIG. 7

A single-pole double-throw switch, having poles 50 and 51, is provided in the circuit which was described relative to FIG. 3, in conjunction with two additional capacitors 52 and 53. When the switch poles 50 and 51 are in contact with terminals 54 and 56, respectively, of the switch, the circuit is connected and operated the same as relative to the embodiment of FIG. 3 (since resistor 24 is connected between terminal 54 and ground, while capacitor 34 is connected between terminal 56 and ground).

When, however, the switch is thrown so that poles 50 and 51 are in contact, respectively, with terminals 55 and 57, both capacitors 52 and 53 are in circuit. Capacitor 52 is then in series with rheostat 23, while the capacitor 53 is in series with rheostate 33 (elements 24 and 34 then being out of circuit).

The values of the capacitors 52 and 53 are so selected as to provide desired changes in the location of the resonance peak produced by the pickup (or pickups) then in circuit, within the audio spectrum. Each capacitor 52 and 53 has a value in the range from about 500 picofarads to about 0.005 microfarads (which produces a total value of from 1000 picofarads to 0.010 microfarads since the two capacitors 52 and 53 are in parallel). As a specific example, which is to be considered as part of the same specific example stated relative to the embodiment of FIG. 3, insofar as component values are concerned, each capacitor 52 and 53 has a value of 0.002 microfarads.

Capacitor 34 has a value at least several times that of capacitor 53.

The single-pole double-throw switch may be provided as a separate switch on the body of guitar 10 shown in FIG. 1. Alternatively, however, such switch may be incorporated in the control element described relative to FIG. 6, for example by associating a push-type switch with such control element or a similar one. With the indicated construction, the guitarist switches poles 50 and 51 between their terminals by merely pushing on knobs 42, the poles being in contact with terminals 54 and 56 after one push on such knob, and in contact with terminals 55 and 57 after a second push on such knob.

Figure 7:
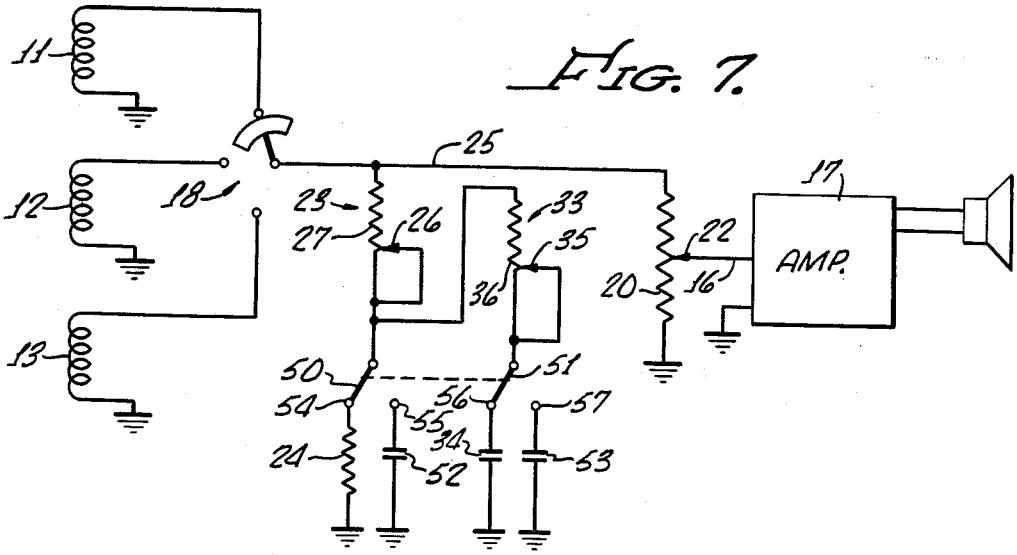
FIG. 7 is a diagram schematically representing an additional embodiment, wherein it is possible to change either the shape or location of the resonance peak.

In performing the method with the embodiment of FIG. 7, let it first be assumed that poles 50 and 51 are in contact with elements 54 and 56, as shown in FIG. 7. The method is then performed as described in detail relative to FIG. 3, and produces the curves shown at 28, 31, and 38 in FIG. 5, all in response to the rotational position of knob 42 and under the full control of the musician.

When the musician does not desire to flatten the resonance peak 29 shown in FIG. 5, but instead to shift such peak (or an equivalent peak) along the audio frequency band, he operates the switch elements, 50, 51 to shift them into engagement with terminals 55 and 57.

Let it be assumed that the control element of FIG. 6 is initially in the fully-clockwise (as viewed from above) position shown in that figure. The output voltage is then substantially the same as indicated by curve 28 in FIG. 5, having the resonance peak 29. Counterclockwise rotation of knob 42 starts movement of resistor 27 beneath its wiper 26 to progressively reduce the effective resistance of such resistor 27. The result is that capacitor 52 becomes progressively more effective until finally, when the control element of FIG. 6 is in its fully-counterclockwise position, resistor 27 has been effectively removed from the circuit and there is a direct connection from lead 25 to ground by way of capacitor 52. Such capacitor has a value selected to change the location of the resonance peak 29 (FIG. 5) substantially, for example, to a much lower position such as one one octave beneath that indicated at 29 in FIG. 5. The substantially octave-lower position is shown in phanton line and indicated by the number 58 in FIG. 5.

Continued counterclockwise rotation of knob 42 (FIG. 6) causes resistor 36 to commence moving beneath its associated wiper 35 to progressively reduce the effective resistance of resistor 36. Finally, when the resistor 36 has been effectively removed from the circuit, capacitors 52 and 53 are connected directly between output lead 25 and ground, in parallel relation to each other.

When capacitors 52 and 53 have equal values, as in the specific example stated above, the capacitance provided between lead 25 and ground has been doubled. The location of the resonance peak has been lowered by approximately another octave, such as to the position shown in phantom line at 59 in FIG. 5.

In the described manner, the resonance peak may be shifted progressively to any position between the ones indicated at 29 (FIG. 5) and 59 in such figure. It may also be flattened from the shape shown at 29 to the flat response shown by curve 31. (It is also possible, by addition of further circuitry, to effect both shifting and flattening of the resonance peak simultaneously.)

It is emphasised that the values of capacitors 52 and 53 are very low, in comparison to capacitors such as are used in tone controls, being sufficiently low that resonance peaks such as those shown at 58 and 59 (FIG. 5) occur at clearly-audible portions of the audio spectrum (not at the extreme lower end of the spectrum). This is to be contrasted with, for example, the situation with respect to much higher-value capacitors, for example, the exemplary 0.022 value of capacitor 34. Such high-value capacitors create any resonance effects at very low, and frequently substantially inaudible (to the average listener) frequencies.

The exemplary capacitance values stated in the above specific example are for the exemplary pickup described relative to FIG. 3. When other pickups are used, for example, those naturally producing resonance at locations much lower on the audio band than what is illustrated in FIG. 5, the permissible degree of downward shifting of the resonance peak, within clearly-audible regions of the audio range, becomes much less. For example, it may not be possible to shift down by two full octaves, and in some instances not even one.

One of the major advantages of the present invention is that much greater control of the characteristics and sounds of an electric guitar (or other musical instrument) having electromagnetic pickups is achieved by control elements located on the guitar itself, as distinguished from an external amplifier disposed at some distance from the guitar where it may not normally be operated during playing of the instrument. Furthermore, and very importantly, the present invention permits major control of sound without the necessity of employing active circuits on the guitar, namely circuits powered by batteries or by electricity supplied from an external source. It is to be understood, however, that the present invention may be combined with active circuits located on the guitar (what are called "on-board electronics") if desired.

The foregoing detailed description is to be clearly understood as given by way of illustration and example only, the spirit and scope of this invention being limited solely by the appended claims.

What is claimed is:

1. A method of adjusting the characteristic sound produced by electric guitars, and other musical instruments, having electromagnetic pickups, which method comprises:

(a) providing resistive loading on at least one electromagnetic pickup of a guitar or other musical instrument;

(b) increasing said resistive loading on said pickup for the purpose of adjusting its characteristic sound by reducing substantially the resonance peak produced by the self-resonance of said pickup;

(c) changing the amount of such increasing to achieve the desired amount of such reduction, and thus a desired characteristic sound, and;

(d) maintaining, regardless of said steps (b) or (c), a predetermined maximum amount of resistive loading on said pickup, said maximum amount being such that:

(1) said pickup remains operatively in circuit and effective to result in audible sounds in the loudspeaker of the musical instrument, and;

(2) said resonance peak is, when said maximum of resistive loading is present, substantially eliminated so that the output of the pickup is substantially flat to produce a "jazz" sound, and;

(3) the apparent volume sensed by a listener to the instrument is not substantially lowered.

2. The invention as claimed in claim 1, in which said musical instrument is an electric guitar, in which said method is performed by means of elements located on the body of said guitar, and in which said method further comprises operating a volume-control means on said guitar body to thus change the volume level of the sound generated by said guitar and the associated amplifier and loudspeaker means.

3. The invention as claimed in claim 1, in which said method is performed employing elements located on the body of an electric guitar, and in which said method further comprises employing a tone-control means, located on said guitar body, to effect a roll-off of the higher-frequency components of the output of said electromagnetic pickup at a region well within the audio spectrum.

4. The invention as claimed in claim 1, in which said method further comprises selectively changing from said resistive loading to primarily capacitive loading, and employing as said capacitive loading capacitor means the value of which is selected to effect a desired shift, along the audio spectrum, of the self-resonance peak of said electromagnetic pickup.

5. The invention as claimed in claim 1, in which said method further comprises providing, at desired times, a variable amount of capacitive loading on said electromagnetic pickup, the size of the capacitor means employed as said capacitive loading being such as to effect a substantial roll-off, within the audio range, of the higher-frequency components of the output from said electromagnetic pickup, and in which said method further comprises providing, at other desired times, a different amount of capacitive loading on said electromagnetic pickup, the size of the capacitor means employed to create said different amount of loading being such as to shift the self-resonance peak of said pickup along the audio spectrum.

6. The invention as claimed in claim 1, in which said step (d) is performed by employing resistor means having a value in the range of about 10 kilohms to about 50 kilohms.

7. The invention as claimed in claim 1, in which said step (d) is performed by employing resistor means having a value in the range of about 20 kilohms to about 30 kilohms.

8. Apparatus for adjusting the characteristic sound generated by an electromagnetic pickup of a guitar or other musical instrument comprising:

(a) variable resistor means connected across said electromagnetic pickup, of a guitar or other musical instrument, to vary the resistive loading on said pickup and thus vary the resonance peak produced by the self-resonance of said pickup, and (b) fixed resistor means connected in circuit with said pickup and with said variable resistor means, said fixed resistor means being so connected, and having such value as, to:

(1) cause the frequency response to be substantially flat when the effective value of said variable resistor means is reduced to zero, this causing the instrument to produce a "jazz" sound, (2) prevent a substantial reduction in the apparent volume sensed by a listener to said instrument, even when the effective value of said variable resistor means is zero, (c) capacitor means, and (d) means to switch said fixed resistor means out of circuit and replace the same by said capacitor means, the circuit relationships being such that adjustment of said variable resistor means then changes the degree of effectiveness of said capacitor means, the size of said capacitor means being so selected that said adjustment effects a shift in the location, along the audio spectrum, of said resonance peak and thus changes the characteristic sound produced by the instrument.

9. The invention as claimed in claim 8, in which said variable resistor means, said fixed resistor means, said capacitor means and said switching means are provided on the body of an electric guitar incorporating said electromagnetic pickup.

10. The invention as claimed in claim 9, in which there are further provided, on said guitar body, a volume control circuit and a tone control circuit, the latter incorporating capacitor means having a capacitance value greatly larger than that of said first-mentioned capacitor means and adapted to effect roll-off within the audio spectrum of higher-frequency components of the output of said pickup.

11. In combination with an electric guitar having at least one electromagnetic pickup, control and circuit apparatus provided on the body of said guitar for changing the sound generated by said pickup, said control and circuit apparatus comprising:

(a) a first rheostat, (b) a second rheostat, (c) fixed resistor means connected in series with said first rheostat, the series combination of said first rheostat and fixed resistor means being connected across said pickup to controllably load the same with a resistive load, said fixed resistor means having a value sufficiently low to damp the self-resonance peak of said pickup and thus create a relatively flat output when said first rheostat is set at zero, but sufficiently high that the apparent volume of said guitar is not substantially reduced when said first rheostat is set at zero, and (d) capacitor means connected in circuit with said second rheostat and so associated with said pickup that adjustment of said second rheostat changes the output sound generated by the guitar, said capacitor means being connected in series with said second rheostat, the series combination of said capacitor means and said second rheostat being connected to the junction between said fixed resistor means and said first rheostat.

12. The invention as claimed in claim 11, in which said capacitor means is connected in series with said second rheostat, and the series combination of said capacitor means and said second rheostat is connected across the output of said pickup by circuit means not including said first rheostat.

13. The invention as claimed in claim 11, in which said capacitor means has such a capacitance value that it will effect a major roll-off, well within the audio spectrum, of the higher-frequency components of the output of said pickup when said second rheostat is set to progressively lower-resistance values.

14. Apparatus for adjusting the characteristic sound generated by an electromagnetic pickup of a guitar or other musical instrument comprising:

(a) variable resistor means connected across said electromagnetic pickup, of a guitar or other musical instrument, to vary the resistive loading on said pickup and thus vary the resonance peak produced by the self-resonance of said pickup, and (b) fixed resistor means connected in circuit with said pickup and with said variable resistor means, said fixed resistor means being so connected, and having such value as, to:

(1) cause the frequency response to be substantially flat when the effective value of said variable resistor means is reduced to zero, this causing the instrument to produce a "jazz" sound, and (2) prevent a substantial reduction in the apparent volume sensed by a listener to said instrument, even when the effective value of said variable resistor means is zero, said fixed resistor means having a value in the range of about 20 kilohms to about 30 kilohms, said fixed resistor means being in series with said variable resistor means.

15. In combination with an electric guitar having at least one electromagnetic pickup, control and circuit apparatus provided on the body of said guitar for changing the sound generated by said pickup, said control and circuit apparatus comprising:

(a) a first rheostat, (b) a second rheostat, (c) fixed resistor means connected in series with said first rheostat, the series combination of said first rheostat and fixed resistor means being connected across said pickup to controllably load the same with a resistive load, said fixed resistor means having a value sufficiently low to damp the self-resonance peak of said pickup and thus create a relatively flat output when said first rheostat is set at zero, but sufficiently high that the apparent volume of said guitar is not substantially reduced when said first rheostat is set at zero, and (d) capacitor means connected in circuit with said second rheostat and so associated with said pickup that adjustment of said second rheostat changes the output sound generated by the guitar, said capacitor means having a capacitance value in the range of about 1000 picofarads to about 0.010 microfarads, said capacitor means being adapted in response to variation of said second rheostat to effect shifting of the self-resonance peak of said pickup along the audio spectrum without markedly changing the height of said peak.

16. In combination with an electric guitar having at least one electromagnetic pickup, control and circuit apparatus provided on the body of said guitar for changing the sound generated by said pickup, said control and circuit apparatus comprising:

(a) a first rheostat, (b) a second rheostat, (c) fixed resistor means connected in series with said first rheostat, the series combination of said first rheostat and fixed resistor means being connected across said pickup to controllably load the same with a resistive load, said fixed resistor means having a value sufficiently low to damp the self-resonance peak of said pickup and thus create a relatively flat output when said first rheostat is set at zero, but sufficiently high that the apparent volume of said guitar is not substantially reduced when said first rheostat is set at zero, (d) capacitor means connected in circuit with said second rheostat and so associated with said pickup that adjustment of said second rheostat changes the output sound generated by the guitar, said capacitor means (d) comprising first and second capacitors one of which has a capacitance value at least several times that of the other, (e) a selector switch provided between said first rheostat and said fixed resistor means, said switch being adapted to disconnect said fixed resistor means from said first rheostat and to connect to said first rheostat, in place of said fixed resistor means, a second capacitor means, and (f) a second selector switch provided between said second rheostat and said capacitor means (d), said selector switches being adapted to cause said one capacitor and said fixed resistor means to be in circuit at one time, and to cause said other capacitor and said second capacitor means to be in circuit at another time, the relationships being such that said first and second rheostats perform different functions relative to the sounds generated by the guitar and in accordance with the positions of said selector switches.

17. In combination with an electric guitar having at least one electromagnetic pickup, control and circuit apparatus provided on the body of said guitar for changing the sound generated by said pickup, said control and circuit apparatus comprising:

(a) a first rheostat, (b) a second rheostat, (c) fixed resistor means connected in series with said first rheostat, the series combination of said first rheostat and fixed resistor means being connected across said pickup to controllably load the same with a resistive load, said fixed resistor means having a value sufficiently low to damp the self-resonance peak of said pickup and thus create a relatively flat output when said first rheostat is set at zero, but sufficiently high that the apparent volume of said guitar is not substantially reduced when said first rheostat is set at zero, and (d) capacitor means connected in circuit with said second rheostat and so associated with said pickup that adjustment of said second rheostat changes the output sound generated by the guitar, said first and second rheostats being responsive to operation of a single actuator, and being so associated with said actuator that operation of said rheostats is sequential as distinguished from simultaneous, the relationships being such that said actuator first effects reduction of the resistance value of said first rheostat until said resistance value is zero, and then effects reduction of the resistance value of said second rheostat until such resistance value approaches zero and said capacitor means (d) performs a progressively greater function in changing the sound emanating from the guitar.

* * * * *